US007146793B1

(12) United States Patent
Hyun

(10) Patent No.: US 7,146,793 B1
(45) Date of Patent: Dec. 12, 2006

(54) WATCH CHAIN

(75) Inventor: Min Kyung Hyun, Seoul (KR)

(73) Assignee: Ecco Watch Co., Ltd., Seoul (KR)

( * ) Notice: Subject to any disclaimer, the term of this patent is extended or adjusted under 35 U.S.C. 154(b) by 0 days.

(21) Appl. No.: 11/268,371

(22) Filed: Nov. 7, 2005

(30) Foreign Application Priority Data

Jun. 27, 2005 (KR) ..... 20-2005-0018546

(51) Int. Cl.
*F16G 15/04* (2006.01)

(52) U.S. Cl. ..... 59/80; 59/83; 63/4; 63/5.1

(58) Field of Classification Search ..... 59/80, 59/83; 63/4, 5.1
See application file for complete search history.

(56) References Cited

U.S. PATENT DOCUMENTS 3,837,163 A * 9/1974 Fujimori ..... 59/80
4,089,161 A * 5/1978 Aoki ..... 59/80
5,197,274 A * 3/1993 Braun ..... 59/80
6,098,394 A * 8/2000 Hashimoto et al. ..... 59/82
6,318,064 B1 * 11/2001 Vandini ..... 59/80
6,374,590 B1 * 4/2002 Walch ..... 59/80
6,564,540 B1 * 5/2003 Greguitch et al. ..... 59/80
6,622,469 B1 * 9/2003 Gunster et al. ..... 59/80

* cited by examiner

*Primary Examiner*—David Jones
(74) *Attorney, Agent, or Firm*—Ladas and Parry LLP

(57) ABSTRACT

A watch chain is disclosed. The watch chain comprises a pin groove formed at a spaced inner surface with a certain depth; a plurality of outer connection pieces which have through holes passing through the inner side of the pin groove in the direction of the back surface; a plurality of central connection pieces which have pin holes at spaced portion with the left and right sides of the same being communicated; a connection pin which passes through the pin hole of the central connection piece and is engaged at the pin groove of the outer connection piece of which both ends are connected with both sides of the central connection piece and with a screw hole being formed at both sides of the connection pin; and a screw which is engaged at the screw hole of the connection pin through the through hole, wherein the central connection piece and the outer connection piece of both sides are engaged so that a connection pin is inserted into the pin groove of the outer connection piece of one side and the pin groove of the outer connection piece of the other side through the pin hole of the central connection piece, and the screw is engaged at the screw hole of the connection pin through the through hole formed at the back surface of the outer connection piece.

3 Claims, 4 Drawing Sheets

WATCH CHAIN

TECHNICAL FIELD

The present invention relates to a watch chain, and in particular to a watch chain in which an outer look of a watch chain is enhanced, so that a product value increases, in such a manner that a pin hole is shown to the outside when outer connection pieces and central connection pieces are connected using a connection pin so as to fabricate a watch chain.

BACKGROUND ART

Generally, as shown in FIGS. 1 and 2, a conventional watch chain 100 includes a plurality of outer connection pieces 10 in which a pin hole 11 is formed at a spaced position of each piece so that the left and right sides of each outer connection piece 10 are communicated with each other. The central connection pieces 20 include pin holes 21 formed at spaced portions so that the left and right sides of the central connection pieces 20 are communicated with each other. A pipe shaped or pin shaped connection piece 30 is inserted into the pin hole 11 of the outer connection piece 10 of one side and the pin hole 11 of the outer connection piece 10 of the other side through the pin hole 21 of the central connection piece 20 so as to engage the central connection piece 20 and the outer connection pieces 10. An additional pin 31 is inserted into the pin hole 11 of the side surface of the outer connection piece 10 and is connected with the connection piece 30. The connection piece 30 is inserted into the pin hole 11 of the outer connection pieces 10 and is fixed by the pin 31, and the central connection piece 20 is rotatable with respect to the connection pin 30.

The pin hole 11 of a new outer connection piece 10 is formed at both sides of another pin hole 21 of the thusly engaged central connection piece 20. The connection pin 30 is inserted into the pin hole 11 of the outer connection piece 10 of one side and the pin hole 11 of the outer connection piece 10 of the other side through the pin hole 21 of the central connection piece 20, and the pin 31 is inserted into the pin hole 11 of the outer connection piece 10.

The outer connection pieces 10 and the central connection pieces 20 are alternately engaged using the connection pins 30 and the pin 31, so that the length of the watch chain can be adjusted with a desired length.

However, the above-described conventional watch chain has the following problems. The connection pin and the pin are inserted into the pin hole of the outer connection piece of the other side through the pin hole of the outer connection pin of which left and right sides communicate and the pin hole of the central connection piece of which left and right sides communicate. With this construction, the pin may be escaped from the pin hole of the outer connection piece as the time passes. In the case that a watch chain is made of a certain special material such as ceramic, etc., the pin cannot be stably fixed because the surface of the ceramic material is slippery. In view of the world-class watch fabrication standard, it is impossible to fabricate a watch chain which can meet the watch chain assembling pressure standard. In addition, when viewing the watch chain in a state that the watch is worn on a user's wrist, since the pin holes are seen from the sides of the outer connection pieces, so that the outer look of the watch chain may be damaged. Therefore, the value of the product may decrease.

In addition, when adjusting the length of the assembled watch chain, a specialist for watch should adjust the length of the watch chain using a certain tool such as a hammer, etc.

DISCLOSURE OF THE INVENTION

Accordingly, it is an object of the present invention to overcome the problems encountered in the conventional art.

It is another object of the present invention to provide a watch chain in which an outer look of a watch chain is enhanced, so that a product value increases, in such a manner that a pin hole is not formed at an outer surface when outer connection pieces and central connection pieces are connected using a connection pin so as to fabricate a watch chain.

It is further another object of the present invention to provide a watch chain in which a connection pin is not escaped from a connection piece so that an outer connection piece and a central connection piece are connected using a connection pin, and a screw is fixed at a connection pin.

It is still further another object of the present invention to provide a watch chain in which it is very easily to adjust the length of a watch chain using a driver when adjusting the length of a watch chain so that an outer connection piece and a central connection piece are engaged using a connection pin, and a connection pin is fixed using a screw at a back side of an outer connection piece.

To achieve the above objects, there is provided a watch chain which comprises a pin groove formed at a spaced inner surface with a certain depth; a plurality of outer connection pieces which have through holes passing through the inner side of the pin groove in the direction of the back surface; a plurality of central connection pieces which have pin holes at spaced portion with the left and right sides of the same being communicated; a connection pin which passes through the pin hole of the central connection piece and is engaged at the pin groove of the outer connection piece of which both ends are connected with both sides of the central connection piece and with a screw hole being formed at both sides of the connection pin; and a screw which is engaged at the screw hole of the connection pin through the through hole, wherein the central connection piece and the outer connection piece of both sides are engaged so that a connection pin is inserted into the pin groove of the outer connection piece of one side and the pin groove of the outer connection piece of the other side through the pin hole of the central connection piece, and the screw is engaged at the screw hole of the connection pin through the through hole formed at the back surface of the outer connection piece.

The both sides of the connection pin are inserted into the pin grove of the outer connection piece and are fixed using a screw through the through hole, and the central connection piece is rotatable with respect to the connection pin.

Parts of both sides of the connection pin are formed in semi-circular shapes, and a screw hole is formed at the semi-circular portion so that the screw is assembled at the semi-circular portion.

MODES FOR CARRYING OUT THE INVENTION

Figure 1:
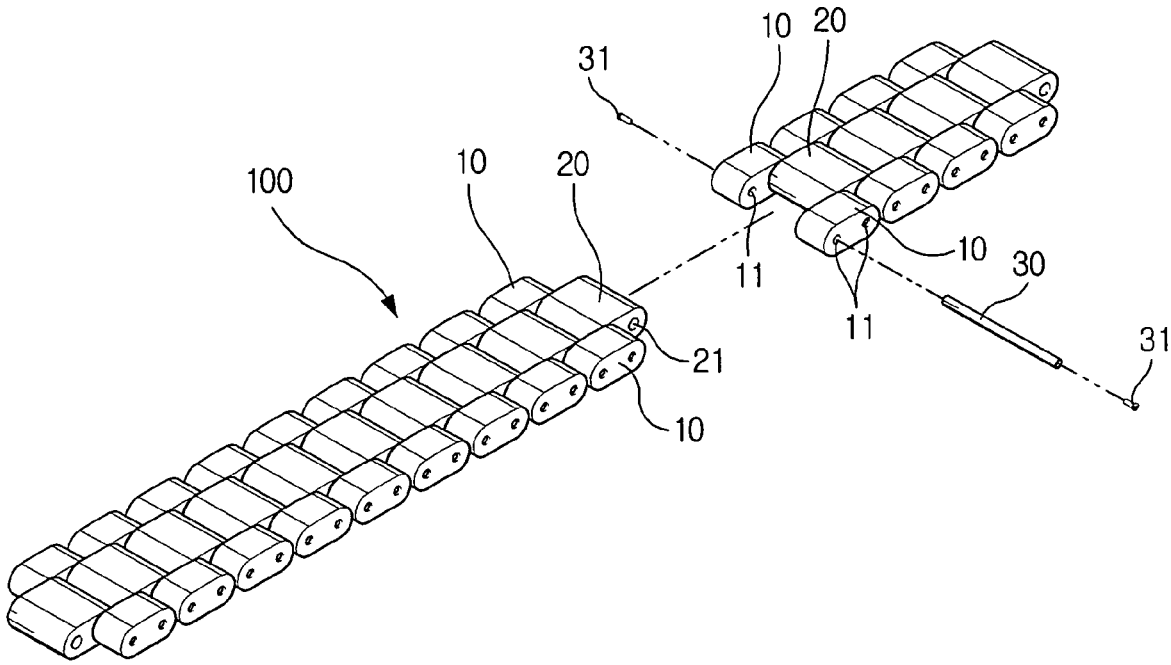
Fig. 1 Prior Art
FIG. 1 is a disassembled perspective view illustrating a connection piece of a conventional watch chain.
Figure 2:
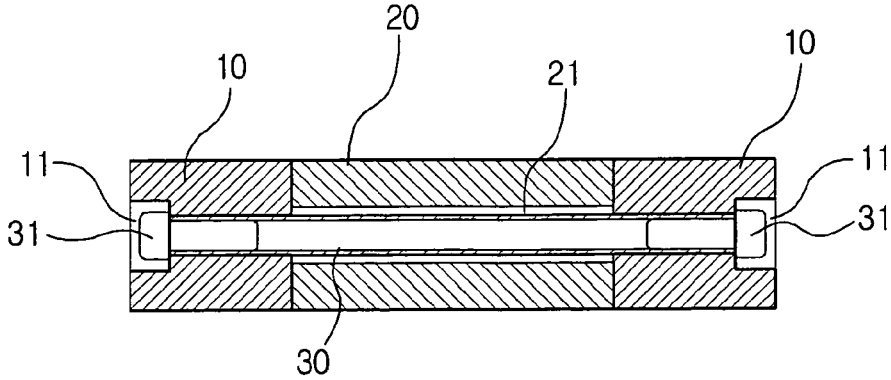
Fig. 2 Prior Art
FIG. 2 is an assembled cross sectional view illustrating a connection piece of a conventional watch chain.
Figure 3:
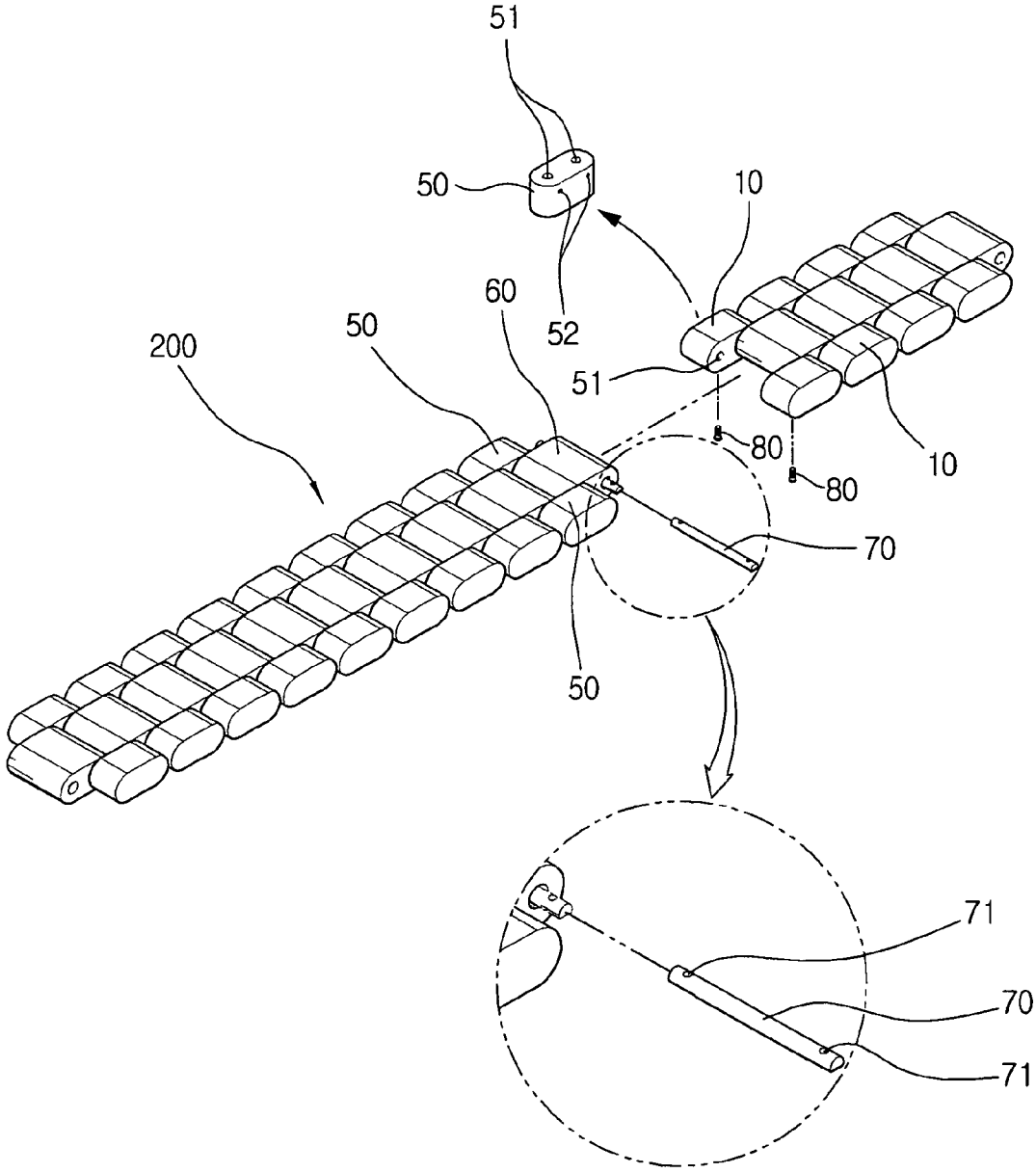
FIG. 3 is a disassembled perspective view illustrating a connection piece of a watch chain according to an embodiment of the present invention.
Figure 4:
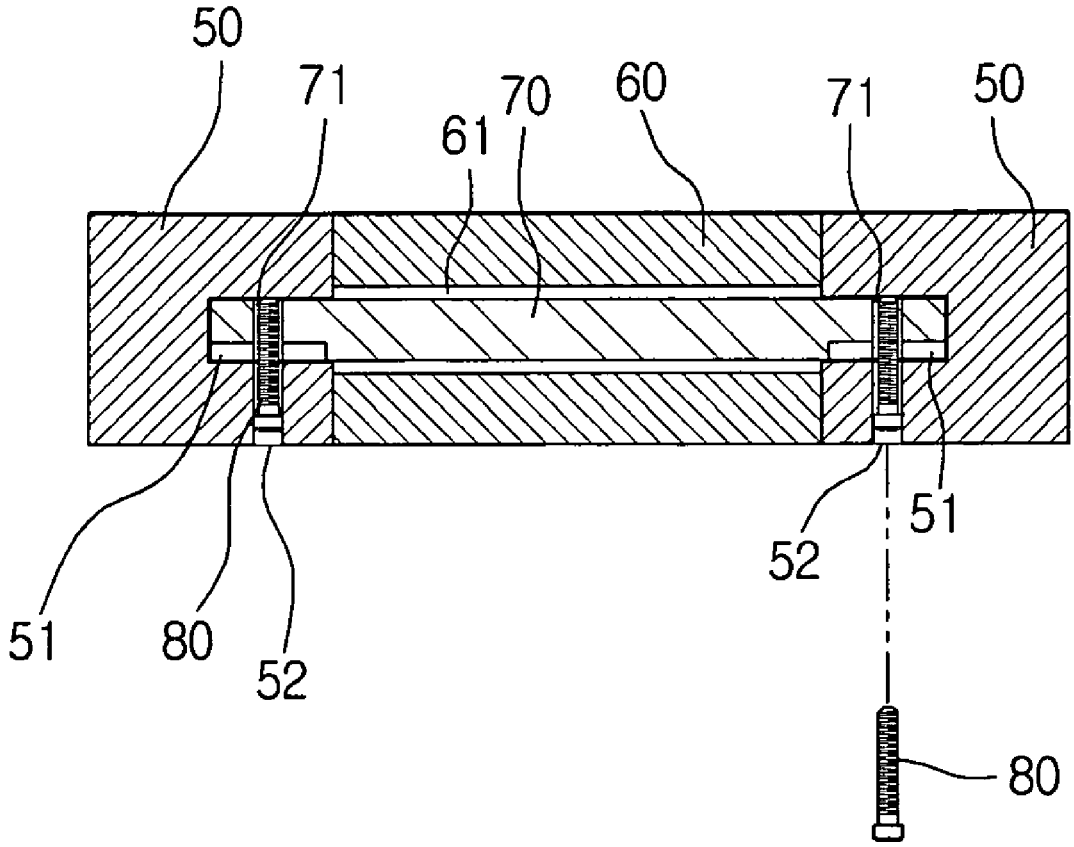
FIG. 4 is an assembled cross sectional view illustrating a connection piece of a watch chain according to an embodiment of the present invention.
Figure 5:
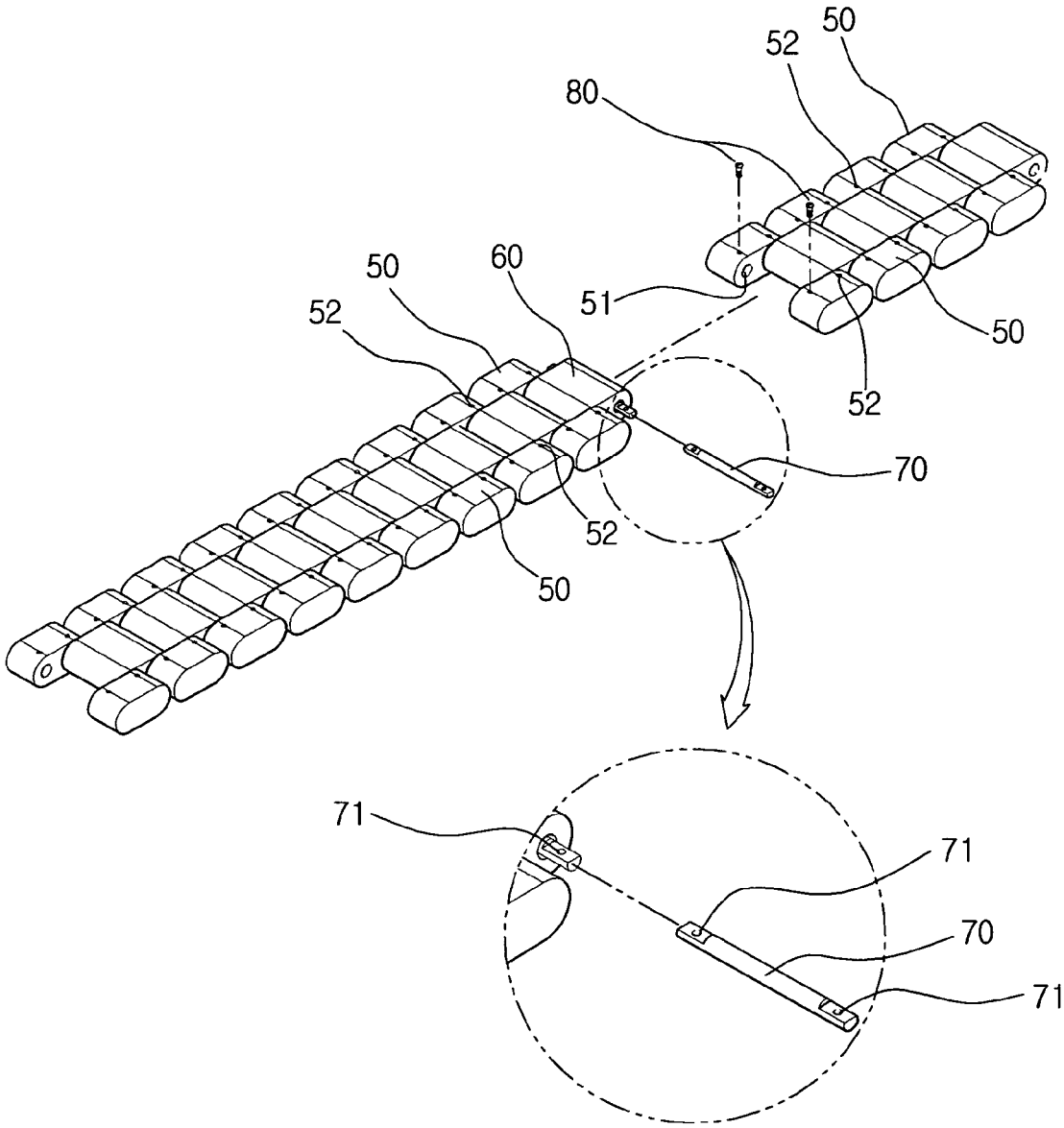
FIG. 5 is a bottom view illustrating a connection piece of a watch chain according to an embodiment of the present invention.

FIG. 3 is a disassembled perspective view illustrating a connection piece of a watch chain according to an embodiment of the present invention, FIG. 4 is an assembled cross sectional view illustrating a connection piece of a watch chain according to an embodiment of the present invention, and FIG. 5 is a bottom view illustrating a connection piece of a watch chain according to an embodiment of the present invention.

As shown in FIGS. 3 through 5, each piece unit of a watch chain 200 according to an embodiment of the present invention includes an outer connection piece 50 of one side, a central connection piece 60, and an outer connection piece 50 of the other side.

Pin grooves 51 are formed at spaced portions at inner sides of the outer connection pieces 50 with certain depths. In addition, a hole 52 communicates with the inner side of each pin groove 51 in the direction of the back surface.

Pin holes 61 are formed at spaced portions of the central connection pieces 60 with the left and right sides being communicated.

A connection pin 70 is engaged at the pin hole 61 of the central connection piece 60 and the pin groove 51 of the outer connection piece 50 connected at both sides. A screw hole 71 is formed at both sides of the connection pin 70. A screw 80 is engaged into the screw hole 71 of the connection pin 70 through a through hole 52 of the outer connection piece 50.

The central connection piece 60 and the outer connection piece 50 of both sides are connected so that the connection pin 70 is inserted into the pin hole 51 of the outer connection piece 50 of one side and the pin groove 51 of the outer connection piece 50 of the other side through the pin hole 61 of the central connection piece 60. The screw 80 is engaged with the screw hole 71 of the connection pin 70 through the through hole 52 formed at the back surface of the outer connection piece 50.

The connection pin 70 is engaged so that the both sides of the same are inserted into the pin groove 51 of the outer connection piece 50, and the screw 80 is fixed through the through hole 52, and the central connection piece 60 is rotatable with respect to the connection pin 70.

Parts of both sides of the connection pin 70 are formed in semi-circular shapes. The screw hole 71 is formed at the semi-circular portion so that the screw 80 is assembled.

The watch chain 200 according to the present invention is assembled in such a manner that the connection pin 70 is inserted into the pin hole 61 of the central connection piece 60, and the pin hole 51 of a new outer connection piece 50 is inserted at both sides of the connection pin 70, and the screw 80 is engaged at the screw hole 71 of the connection pin 70 through the through hole 52 of the outer connection pin 50 of one side, and the screw 80 is engaged at the screw hole 71 of the connection pin 70 through the through hole 52 of the outer connection piece 50 of the other side.

The length of the watch chain can be adjusted in such a manner that the outer connection piece 50 and the central connection piece 60 are alternately engaged with the connection pin 70 and the screw 80.

In the case of the watch chain 200 according to the present invention, the outer connection piece 50 and the central connection piece 60 are engaged using the connection pin 70, and the connection pin 70 is fixed using the screw 80 through the through hole 52 formed at the back surface of the outer connection piece 50. Therefore, in the present invention, it is very easy to adjust the length of the watch chain using one driver when adjusting the length of the watch chain.

As described above, in the present invention, when the outer connection piece and the central connection piece are connected using the connection pin so as to form the watch chain, the pin hole is not formed at the outer surface, so that the outer look of the watch chain is enhanced, and the product value increases. As the outer connection piece and the central connection piece are connected using the connection pin, and the screw is fixed at the connection pin, the connection pin is not escaped from the connection piece. When adjusting the length of the watch chain, anyone can easily adjust the length of the watch chain using one driver.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a watch chain comprising central connection pieces respectively having pin holes from left sides through to right sides thereof, and left and right outer connection pieces respectively at the left and right sides of the central connection pieces, the improvements wherein:

a pin grooves extend into the left and right outer connection pieces from respective right and left sides thereof in alignment with the pin holes of the central connection pieces;

through holes pass through the outer connection pieces from the pin grooves to back surfaces thereof;

connection pins respectively pass through the pin holes of the central connection pieces and into the pin grooves of the outer connection pieces at opposite ends, the opposite ends of the connection pins having respective screw holes; and screws engage the screw holes of the connection pins through the through holes.

2. The watch chain of claim 1, wherein the central connection pieces are respectively rotatable with respect to the connection pins.

3. The watch chain of claim 1, wherein the opposite ends of the connection pins are semi-circular in cross section at the screw holes.

* * * * *